US010535327B2

(12) United States Patent
Hunsicker

(10) Patent No.: US 10,535,327 B2
(45) Date of Patent: Jan. 14, 2020

(54) TRUMPET SLIDE RING SPACER

(71) Applicant: WICHITA STATE UNIVERSITY, Wichita, KS (US)

(72) Inventor: John David Hunsicker, Wichita, KS (US)

(73) Assignee: Wichita State University, Wichita, KS (US)

( * ) Notice: Subject to any disclaimer, the term of this patent is extended or adjusted under 35 U.S.C. 154(b) by 0 days.

(21) Appl. No.: 16/244,981

(22) Filed: Jan. 10, 2019

(65) Prior Publication Data

US 2019/0213981 A1 Jul. 11, 2019

Related U.S. Application Data

(60) Provisional application No. 62/616,043, filed on Jan. 11, 2018.

(51) Int. Cl.
*G10D 9/04* (2006.01)
*G10D 7/10* (2006.01)

(52) U.S. Cl.
CPC ..... *G10D 9/04* (2013.01); *G10D 7/10* (2013.01)

(58) Field of Classification Search
CPC ..... G10D 9/04; G10D 7/10
See application file for complete search history.

(56) References Cited

U.S. PATENT DOCUMENTS 1,662,076 A * 3/1928 Newman ..... G10D 7/10 84/394
2,734,417 A * 2/1956 Hindsley ..... G10D 7/10 84/394
2,988,948 A * 6/1961 Eash ..... G10D 9/04 84/392
3,433,114 A * 3/1969 Seme ..... G10D 7/10 84/394
4,276,804 A * 7/1981 Holland ..... G10D 9/005 84/394
5,644,095 A * 7/1997 Davidson ..... G10D 7/10 84/387 R
7,335,831 B2 * 2/2008 Laukat ..... G10D 7/10 84/387 R
7,396,985 B1 * 7/2008 Roth ..... G10D 7/10 84/385 A
8,278,540 B1 * 10/2012 Chen ..... G10D 7/10 84/387 R
9,255,815 B2 2/2016 Maldonado
9,595,246 B2 * 3/2017 Hagstrom ..... G10D 9/04
2016/0049138 A1 * 2/2016 Adkins ..... G10D 9/06 84/400
2019/0213981 A1 * 7/2019 Hunsicker ..... G10D 7/10

OTHER PUBLICATIONS

Zubin John, et al., "Trumpet Ergonomics Redesign", Computer Graphics & Computer Aided-Design Project, Spring 2011, George W. Woodruff School of Mechanical Engineering, Georgia Institute of Technology, Atlanta, GA.
Sydney Payne, "Music Professor Invents the Gapper, a Device to Aid in Playing the Trumpet", Jun. 2018, WSU News, Wichita, KS.

* cited by examiner

*Primary Examiner* — Robert W Horn
(74) *Attorney, Agent, or Firm* — Stinson LLP

(57) ABSTRACT

Structures and methods are provided for adjusting a size of a slide ring aperture for a musical instrument. Embodiments include a trumpet slide ring spacer adapted to be mounted on an instrument and retained within a valve slide ring.

11 Claims, 17 Drawing Sheets

TRUMPET SLIDE RING SPACER

CROSS REFERENCE TO RELATED APPLICATIONS

This application claims the benefit of U.S. Provisional Patent Application No. 62/616,043, filed on Jan. 11, 2018, which is incorporated by reference herein, in its entirety, for all purposes.

STATEMENT REGARDING FEDERALLY SPONSORED RESEARCH

Not Applicable.

BACKGROUND

The present invention relates in general to musical instruments, and, more specifically, to a device and method for use with a finger ring or loop that is moved while playing a musical instrument. Finger rings of this type are frequently used while playing a trumpet or a cornet.

Playing certain musical instruments, such as the trumpet, requires a musician to move a slide while playing, using a finger inserted into a ring. However, the size and shape of the ring may be poorly matched to the musician's finger. Musicians with small hands may find that the gap between the finger and an edge of the ring makes it difficult to quickly extend and retract the slide to play certain notes or sequences of notes. This difficulty may cause undue stretching, straining, and tension in the musicians' hand, and may lead student musicians to play out of tune or avoid playing particular musical pieces.

To ameliorate the gap between the ring and finger, some musicians may wrap tape around a part of the ring to reduce the gap. While tape may provide some temporary assistance, it is not aesthetically pleasing, adhesives in the tape may lead to tarnishing or other damage to the instrument, and the tape may shift unexpectedly during a performance.

SUMMARY

In an aspect of the invention, structures and methods are provided for adjusting a size of a slide ring aperture for a musical instrument. Embodiments include a trumpet slide ring spacer adapted to be mounted on an instrument and retained within a third slide valve side ring.

The invention will be explained in greater detail by way of example with reference to the figures, in which the same references numbers are used in the figures for identical or analogous elements. The above features and advantages and other features and advantages of the present invention are readily apparent from the following detailed description of the best modes for carrying out the invention when taken in connection with the accompanying drawings of exemplary embodiments.

DETAILED DESCRIPTION

Musicians must execute coordinated motions to control the tone of an instrument. For example, a trumpet player uses their fingers to control valves and slides to achieve a wide range of tones. Trumpets achieve different pitches by modulating airflow through the instrument using one or more valves while playing. Slides connect tubing through the valves. Use of the slides increases the length of the tubing, thereby lowering the pitch. The slides are adjustable for tuning and playing particular notes. The main tuning slide is often set in position before playing, and the first and third valve slides are repositioned while playing. Thus, a musician's control of the first and third valve slides is important during a musical performance.

The third valve slide allows trumpet players to change the intonation of the instrument when the third valve is pressed. Use of the third valve slide enables trumpeters to play lower notes, such as C-sharp and D-natural with precision. To use the third valve slide effectively, a musician should be able to extend or retract the slide rapidly, and with precision, while playing. The third valve slide is controlled by moving a finger of the left hand encircled by the ring or loop portion of the third valve slide, which adjusts tubing length when air passes through the third valve. The ring moves linearly, back and forth along a direction of travel parallel to the main body of the instrument.

For many musicians, the size of the loop is much larger than the finger placed in the loop and used to move the valve slide. When the loop is a poor fit for the finger used to actuate the valve slide, the musician may have difficulty playing some notes with a desired level of speed, accuracy, and precision. A trumpeter may find that the ring for manipulating the third valve slide is too large with respect to the musician's finger. The poor fit may cause delay between finger movement and instrument response, resulting in difficulty achieving a desired sound. The size discrepancy between finger and ring may also lead to hand discomfort and interfere with a players natural playing style or instrument hold.

Embodiments of the invention facilitate greater control over the third valve slide and enhance comfort. Described ring fit adapters or spacers facilitate quicker, more agile movement of the third valve slide ring.

Illustrative examples for use with a trumpet are described. For the purposes of the embodiments of the invention described herein, the features of the cornet are analogous to the trumpet, and unless otherwise specified, the term "trumpet" as used herein, includes the cornet.

Figure 1A:
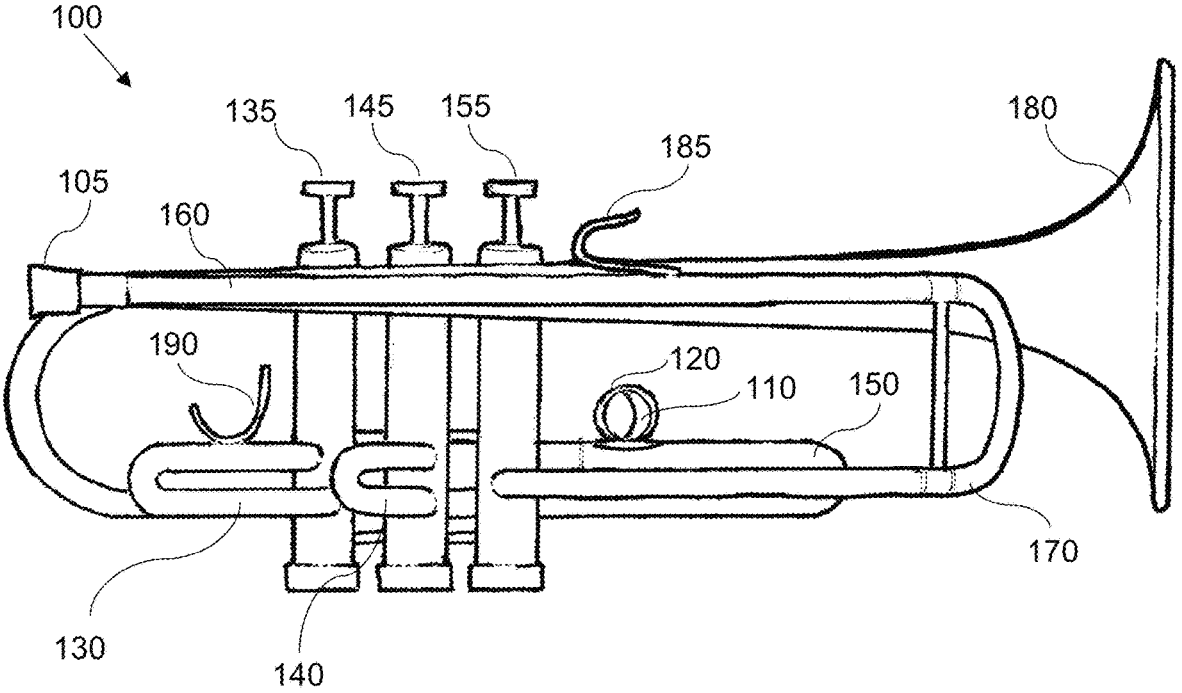
FIG. 1A depicts an example of a musical instrument with an embodiment of the invention.

FIG. 1A shows an example of a trumpet 100. Air enters the trumpet through the mouthpiece 105 and exits the instrument through the bell 180. Changes to the airflow path through the instrument modulate sounds produced by the instrument. As air enters, it passes into the lead pipe 160 and through the main tuning slide 170, towards the valve slides. By manipulating the first valve 135, second valve 145, and third valve 155, the musician controls the path of airflow and determines whether the air passes through the first valve slide 130, second valve slide 140, and/or third valve slide 150, respectively. The third valve slide ring 120 is used to extend or retract the third valve slide 150 to adjust an airflow path length as air passes through the third valve slide 150. The third valve slide ring 120 is attached to the third valve slide 150 and moves linearly along a path of travel parallel to the body of the instrument. In many instruments, the third valve slide ring defines a substantially circular aperture. Embodiments of the invention include fit adapters, or spacers 110, which are positioned within the aperture of the third valve slide ring 120.

Figure 1B:
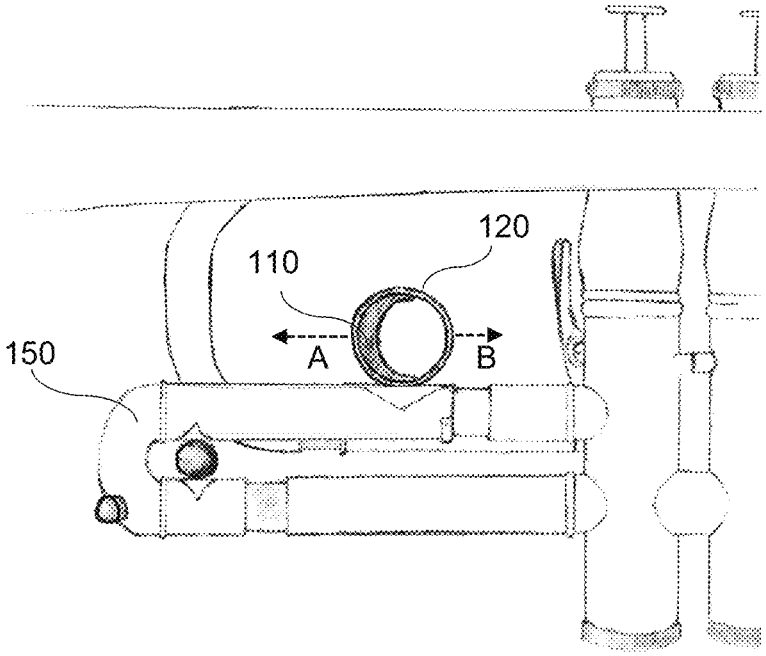
FIG. 1B depicts a detail of a musical instrument with an embodiment of the invention positioned with respect to the instrument.

FIG. 1B shows a detail of a portion of an instrument from the opposite side relative to FIG. 1A. FIG. 1B shows the third valve slide 150 and a fit adapter, or spacer 110, positioned with respect to the third valve slide ring 120. A path of travel, for the third valve slide ring 120, outward from the musician is indicated by dotted-line arrow A. And a path of travel inward toward the musician is indicated by dotted-line arrow B.

Figure 2:
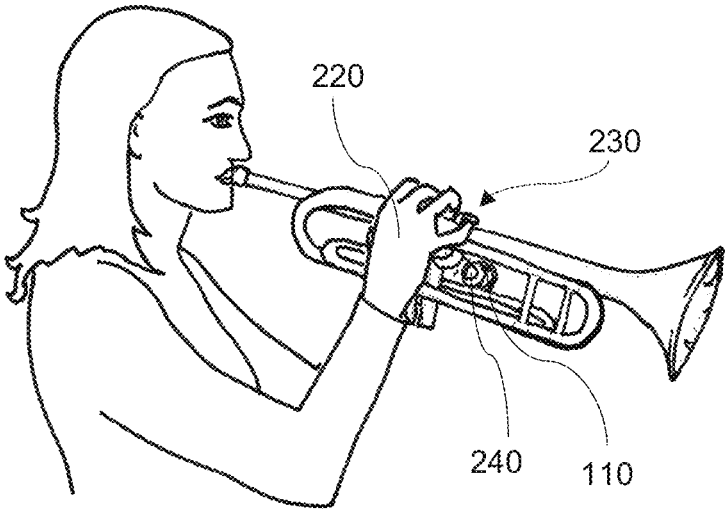
FIG. 2 shows a musician playing an instrument of with an embodiment of the invention.

Turning now to FIG. 2, with reference to FIG. 1, a musician plays the trumpet 100 using the right hand 220 to manipulate the valves and the left hand 230 to both support the instrument and manipulate the first 130 and third valve slides 150. Generally, the index, middle and ring fingers of the right hand are used to move the valves. The right pinky finger rests in or on a pinky support ring or hook 185 on the top of the instrument. The left hand carries the majority of the trumpet's weight. The thumb of the left hand sits in a thumb hook 190 connected to the first valve slide 130 and the thumb hook 190 can be used to adjust the first valve slide 130. The left thumb and left index finger substantially support the instrument. A finger 240, usually the ring finger, the middle finger, or the pinky finger of the left hand sits in the loop portion of the third valve slide ring 120, which is used to move the third valve slide 150. The fingertip 240 is shown positioned in the third valve slide ring 120 resting against the ring portion proximate to the mouthpiece 105 and opposite the bell 180. An embodiment of the invention 110 is shown positioned in the ring, opposite the finger rest position, seated against the ring segment proximate to the bell.

Figure 3:
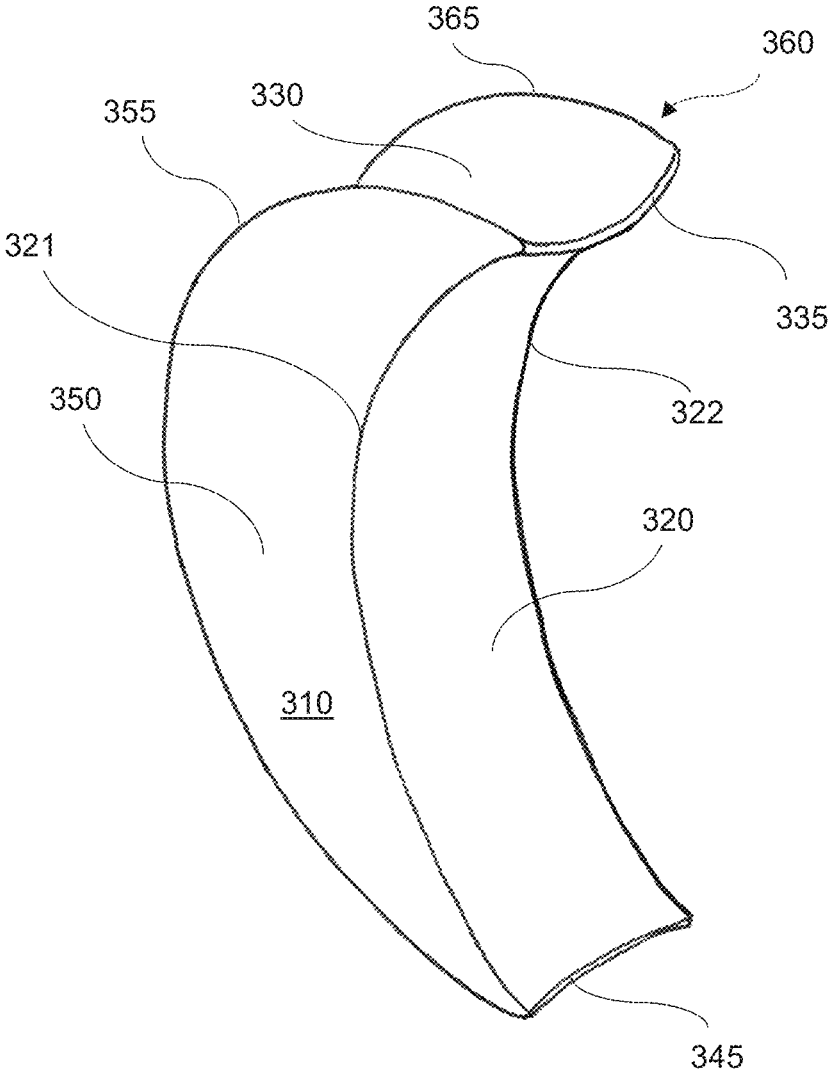
FIG. 3 shows an embodiment of the invention.

FIG. 3 shows an embodiment of the invention with a substantially crescent-shaped side profile, like the embodiments depicted in FIGS. 1-2. The spacer 310 has a curved outer portion, the ring seating surface 330, which is configured to rest against, and seat into, a portion of the third valve slide ring inner circumference. An inner surface of the spacer, the finger contacting surface 320, is configured to contact the finger of a musician when extending the slide. Other regions of the spacer may also contact the finger or hand. In the embodiment shown, the finger contacting surface 320 meets the ring seating surface 330 at a top edge 335 and a bottom edge 345. The spacer shown has a substantially crescent-shaped side profile with a first side 350 configured to be adjacent to a player's left hand, and a second side 360, opposite the first side, having the same dimensions in mirror image. The widest breadth across each of the first 350 and second sides 360 is located across the center of the crescent, about half-way between the top and bottom edge points.

As shown in FIG. 3, the ring seating surface 330 of the spacer 310, may be curved to conform to one or both of an inner circumference and a radial curve of the third valve slide ring. If the slide ring generally describes a torus, an inner circumference is along a toroidal direction, and a radial curve is along a poloidal direction.

An arcuate shape of the ring seating surface 330, between the top edge 335 and bottom edge 345, can conform to and seat into a portion of the inner circumference of a slide ring.

The ring seating surface 330 may further seat around a part of the radial curve of the ring, in the poloidal direction, with a contour or depression between a first side circumferential outer edge, or a first rim 355, and an outer edge of the second side, a second rim 365. The contour may be concave to better seat onto a convex radial curve of the third valve slide ring inner surface. Alternately, the depression may be squared off, with one or both of the rims forming a channel side wall. A concavity or depression between the first rim 355 and second rim 365 may define a seating channel having a depth. A seating channel depth may be defined as a radial distance from a rim level to a corresponding channel base level along an arcuate midline on the seating surface 330 halfway between the first rim 355 and second rim 365. In some embodiments, a seating channel depth corresponds to between 5-50% of a ring band thickness. In some embodiments, a seating channel depth is about 0.1 to 1.5 mm.

Figure 4:
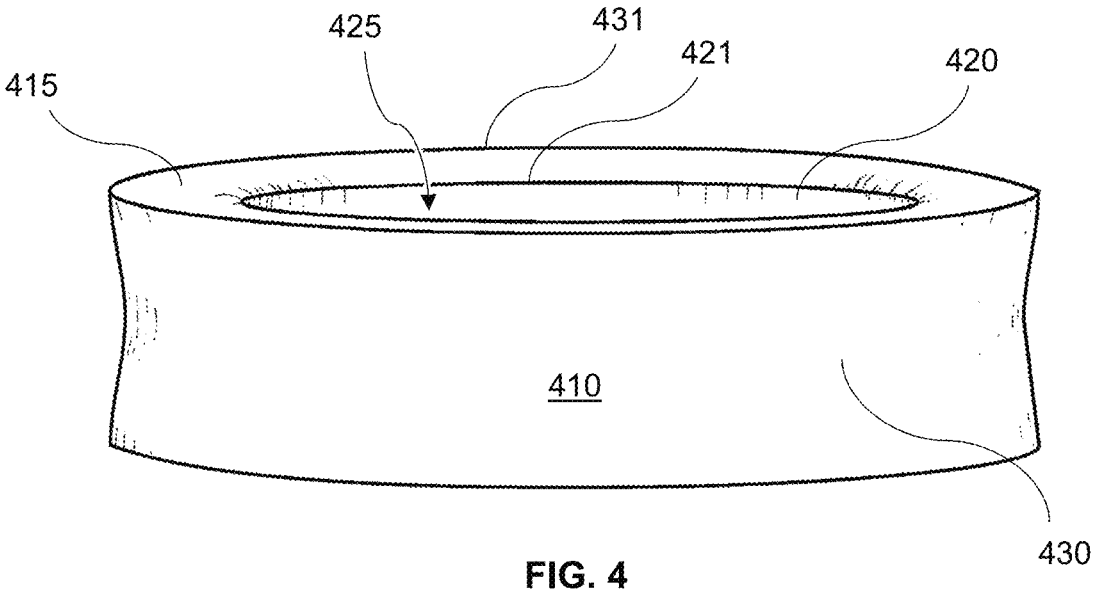
FIG. 4 shows another embodiment of the invention.

Turning to FIG. 4, an embodiment of a fit adapter or spacer 410 may seat into a full inner circumference of a valve slide ring. A circlet or band 415 may encircle a finger aperture 425. An interior portion of the spacer may define a primary finger contacting surface 420. The spacer 410 may have a ring seating surface 430 around its outer circumference, configured to fit within the inner circumference of the slide ring. In some embodiments, the ring seating surface 430 is contoured with curvature to conform to both an inner circumference and a radial curve of a slide ring.

As depicted in FIG. 4, a band width may be substantially similar throughout the fit adapter or spacer 410, differing by less than 10% in width across any radial band segment. In some embodiments, a thickness of the band width is approximately 1-20%, or preferably 2-15%, of the diameter of the inner circumference of the slide ring. The band width may be defined by a radial distance between an inner rim 421, around an inner circumference of the band 415, and an outer rim 431, around an outer circumference of the band 415. In some embodiments, surfaces are curved such that an inner rim 421 or outer rim 431 are less distinct, and a band width may be defined by an average radial thickness between the inner finger contacting surface 420 and the ring seating surface 430.

Figure 5:
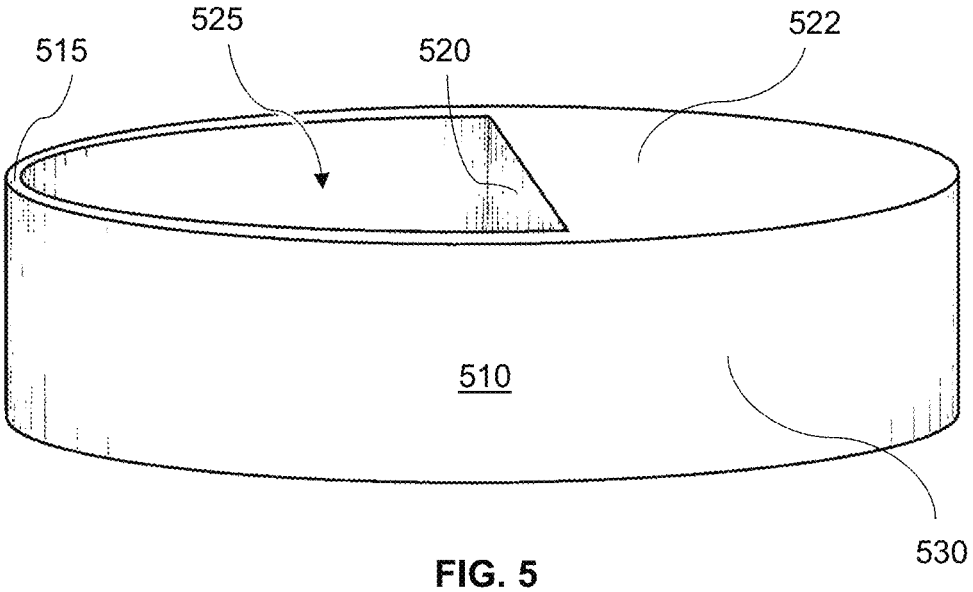
FIG. 5 shows another embodiment of the invention.

Turning to FIG. 5, an embodiment of a fit adapter or spacer 510 may seat into a full inner circumference of a valve slide ring and have a non-uniform shape. A narrow band segment 515 may encircle a finger aperture 525. An interior portion of the spacer may define a finger contact surface 520 configured to transmit force from a center region, through a thickness of an inset segment 522 for extending the slide ring outward. The spacer 510 has a ring seating surface 530 around its outer circumference, configured to fit within the inner circumference of the slide ring. In some embodiments, the ring seating surface 530 may be contoured with curves to conform to an inner circumference and a radial curve of a slide ring. In some embodiments, the finger contact surface 520 and inset segment 522 may be contoured to improve finger grip and hand comfort by curving edges and sloping surfaces to conform to finger shape. In some embodiments, a thickness of the inset segment 522 across a diameter of the spacer 510 at its thickest point is approximately 2-50% or 5-40% of the diameter of the inner circumference of the slide ring.

Figure 6A:
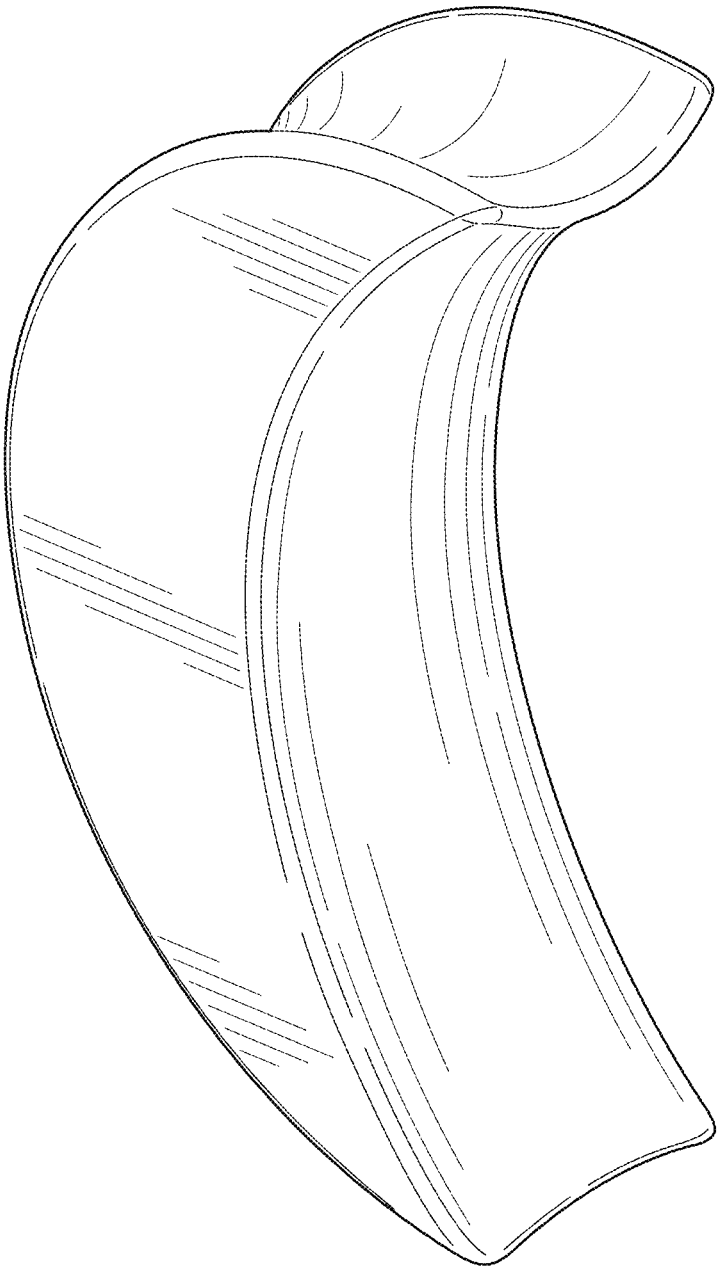
FIGS. 6A-6H show views of the embodiment of FIG. 3.
Figure 6B:
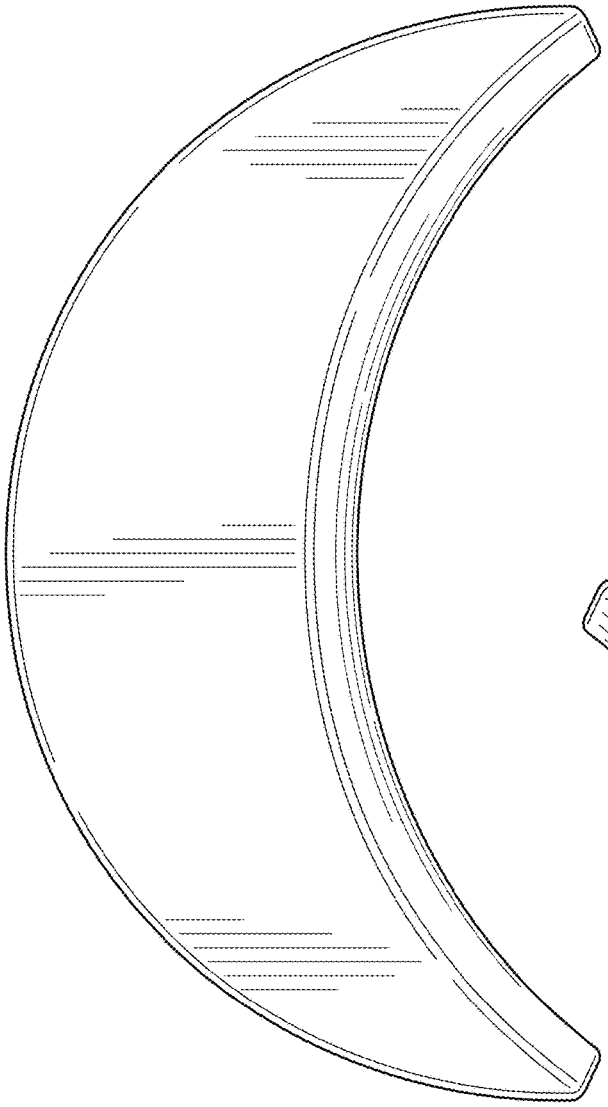
Figure 6C:
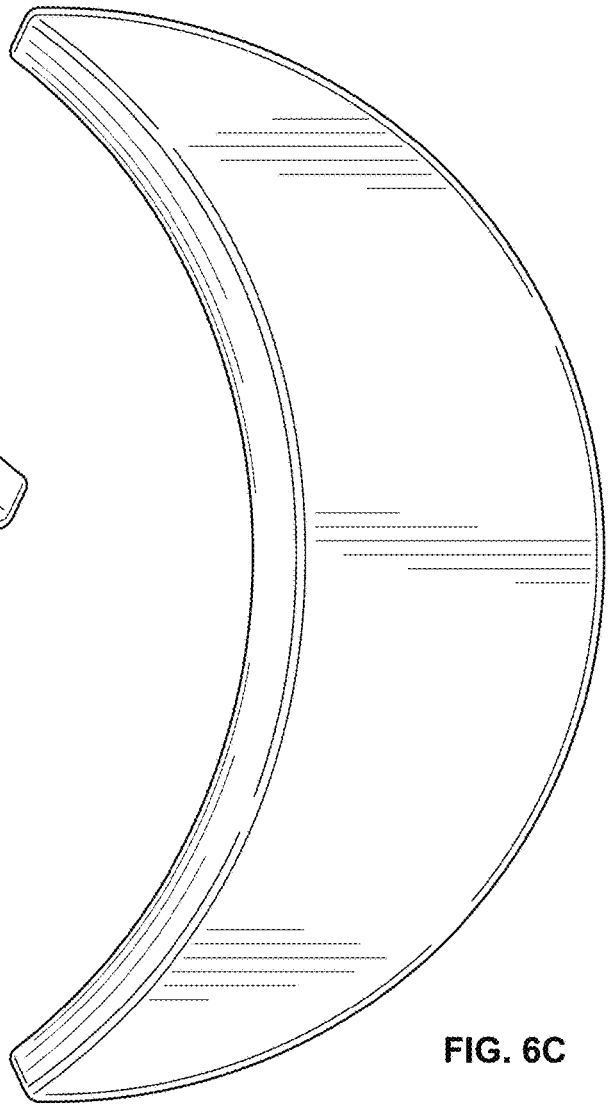
Figure 6D:
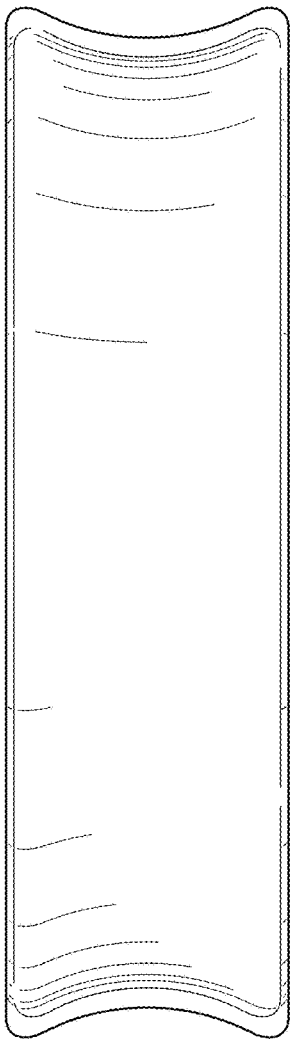
Figure 6E:
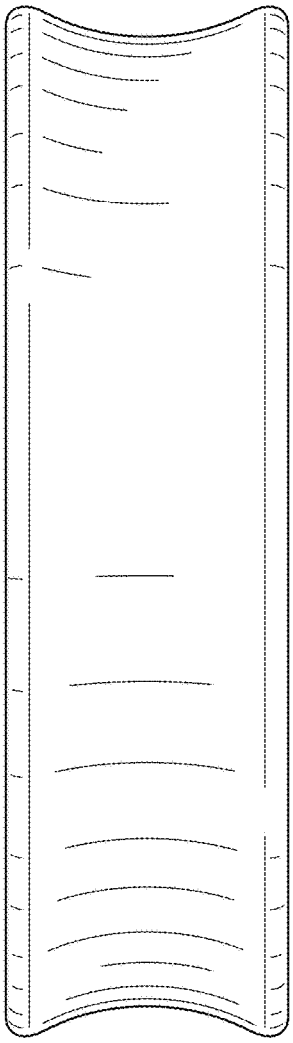
Figure 6F:
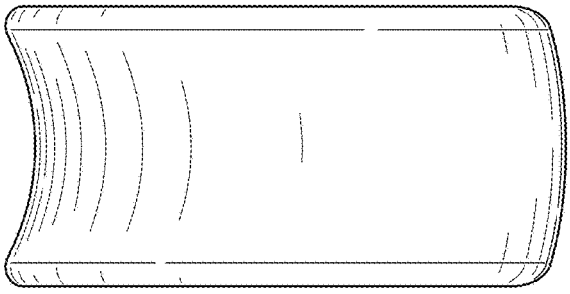
Figure 6G:
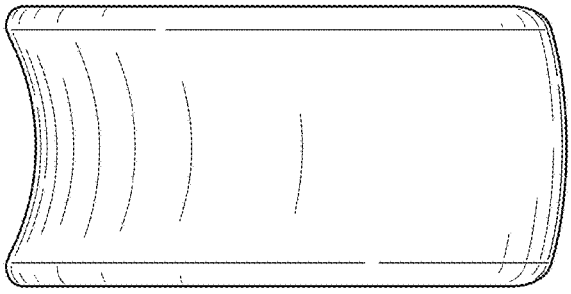
Figure 6H:
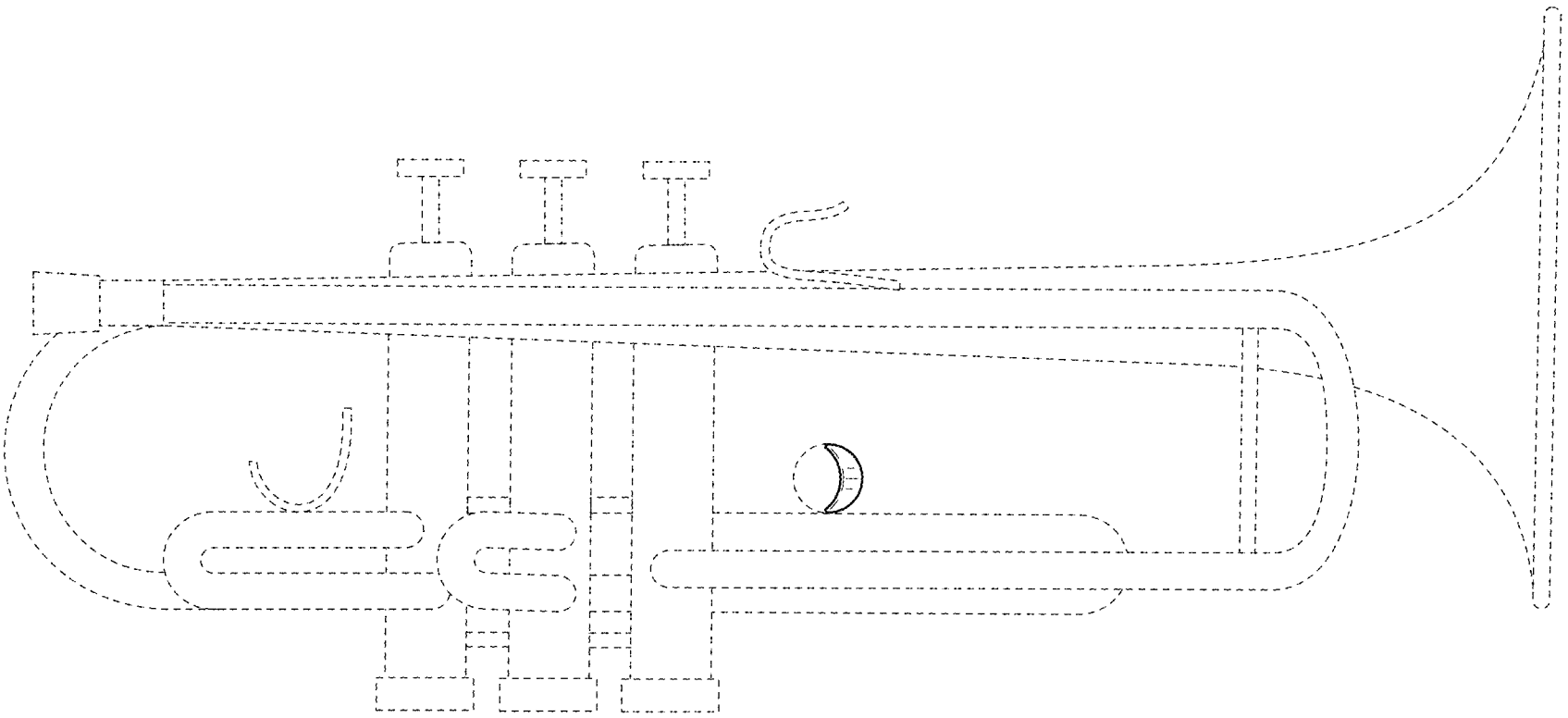

FIGS. 6A-6H show views of the embodiment of the trumpet slide ring fit adapter or spacer of FIG. 3. FIG. 6A depicts an isometric front view showing an inner curve of the finger contacting surface and the side proximate to a player's left hand when the spacer is positioned as shown in FIGS. 1-2. FIG. 6B depicts a left side elevational view. FIG. 6C depicts a right side elevational view. FIG. 6D depicts a front side elevational view. FIG. 6E depicts a back side elevational view. FIG. 6F depicts a top plan view. FIG. 6G depicts a bottom plan view. FIG. 6H depicts a right side elevation view showing the spacer positioned for use in an instrument with the instrument depicted in broken lines.

Figure 7A:
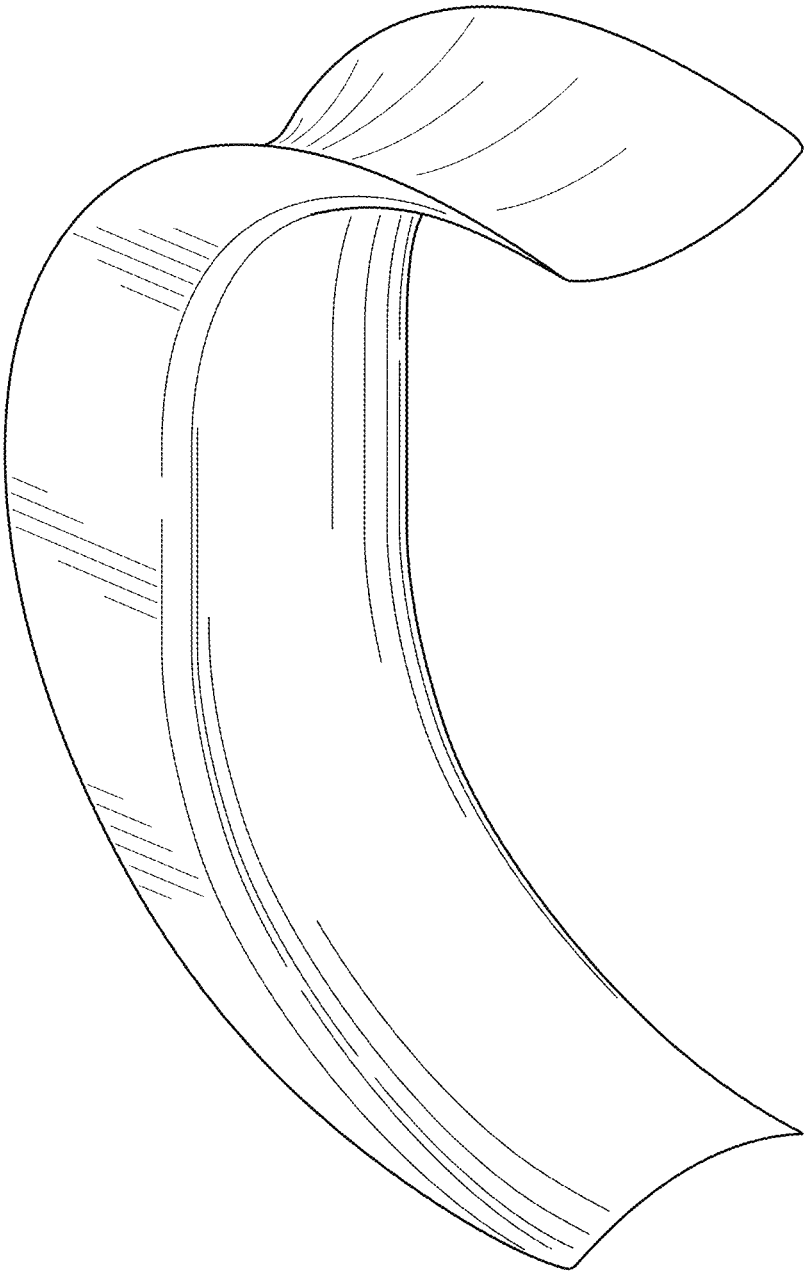
FIGS. 7A-7H show views of an embodiment of the invention.
Figure 7B:
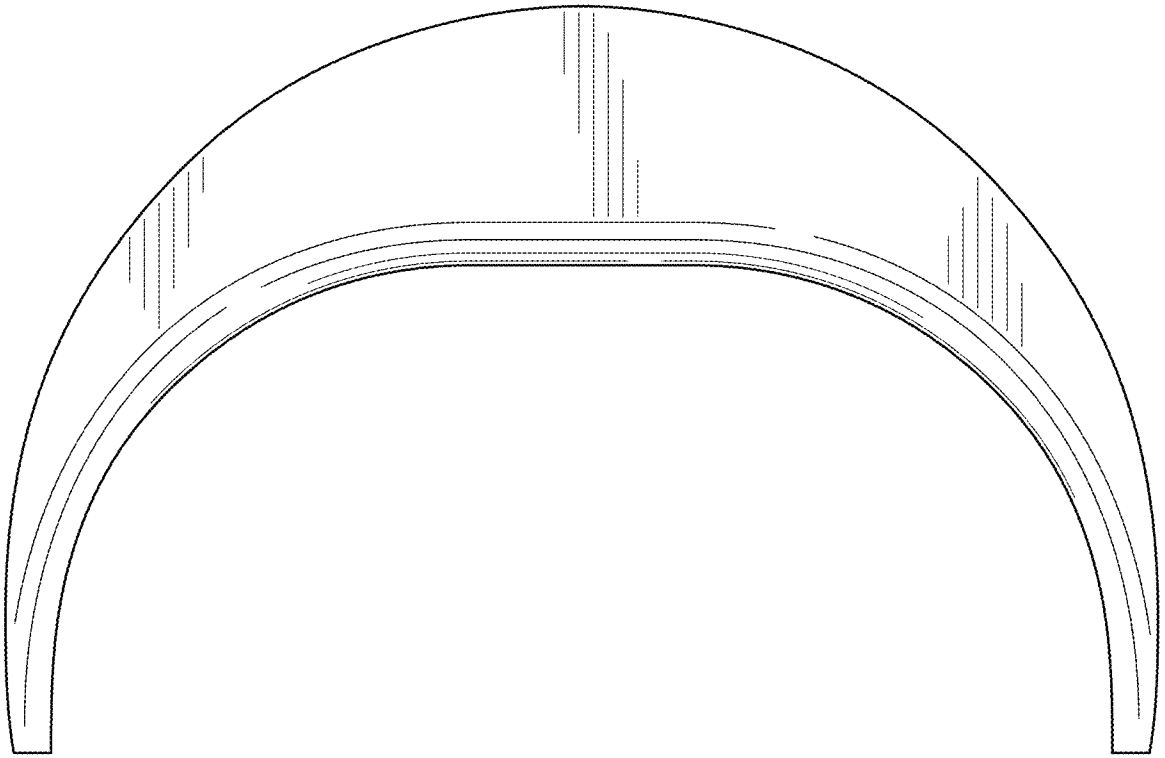
Figure 7C:
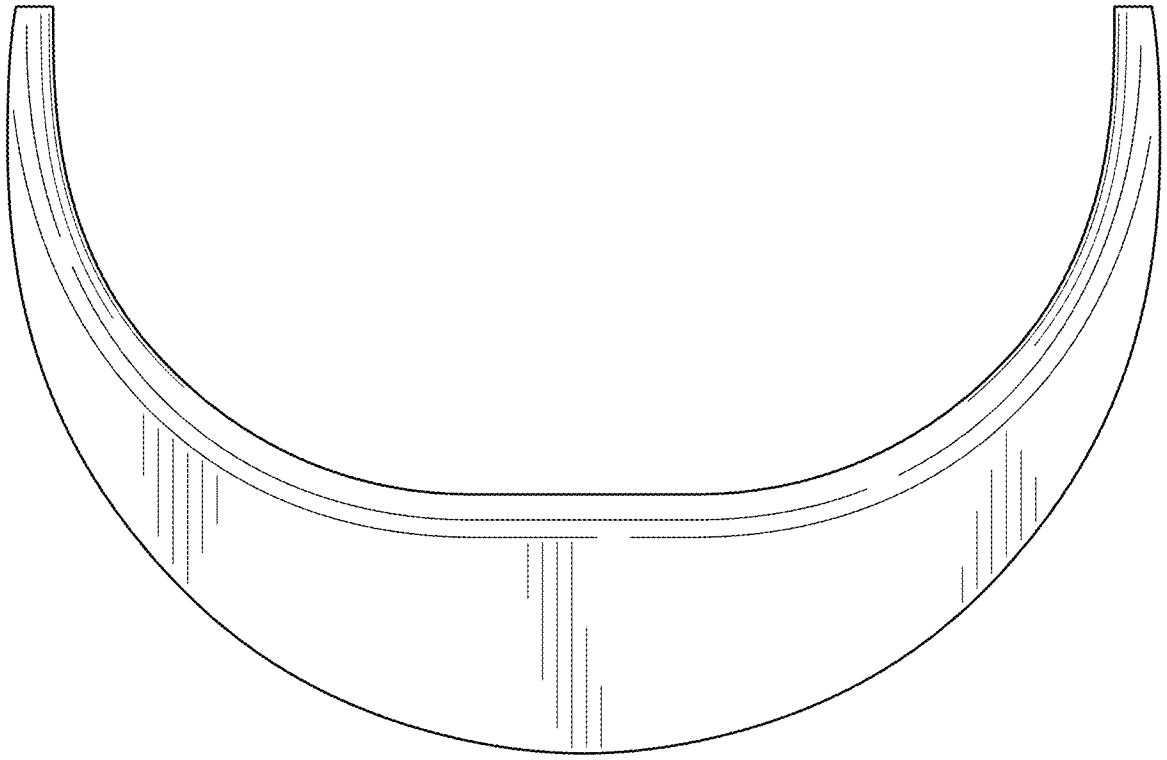
Figure 7D:
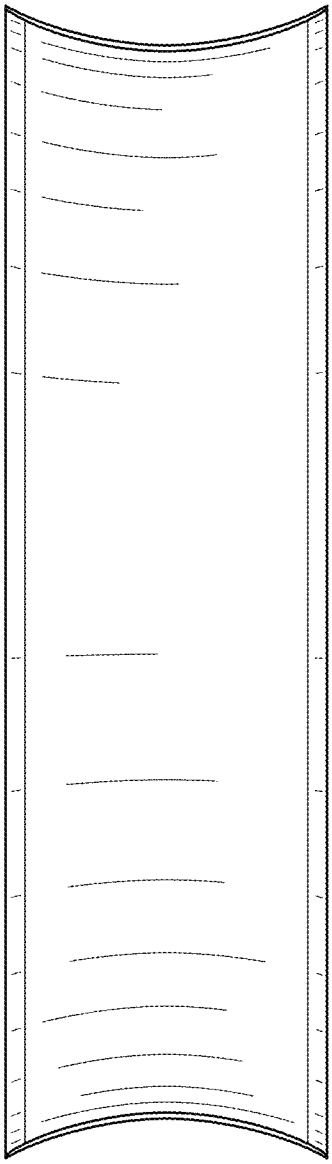
Figure 7E:
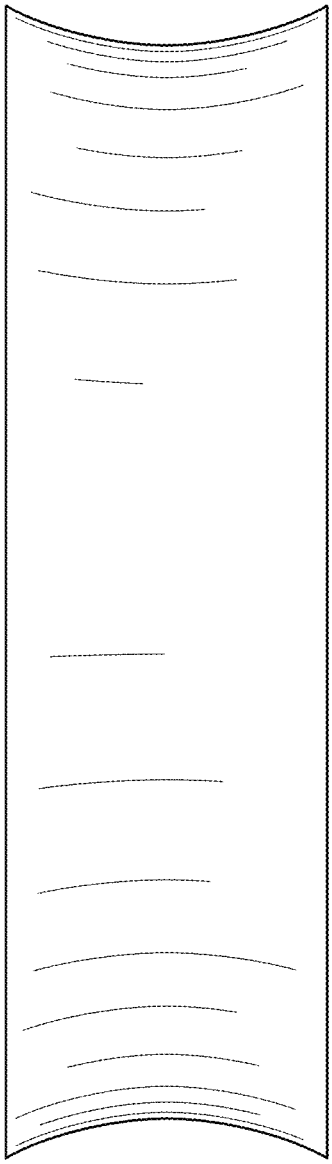
Figure 7F:
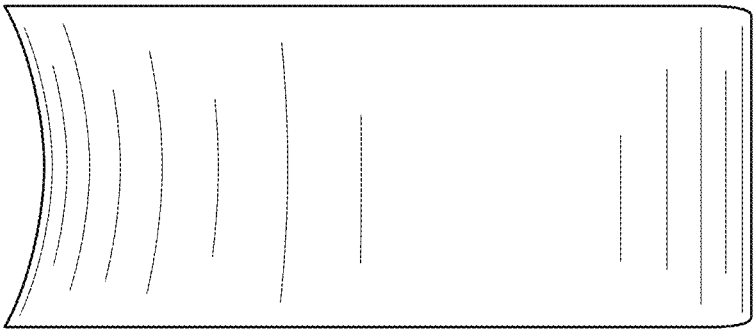
Figure 7G:
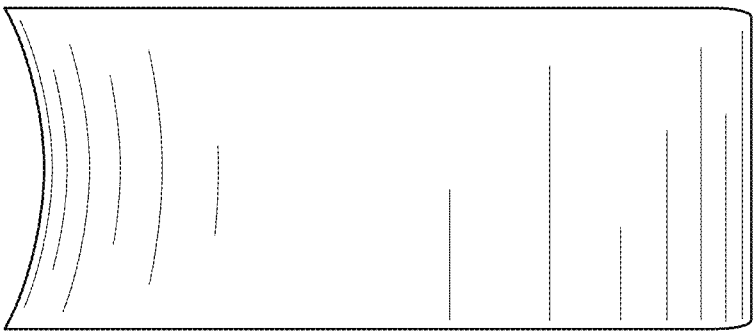
Figure 7H:
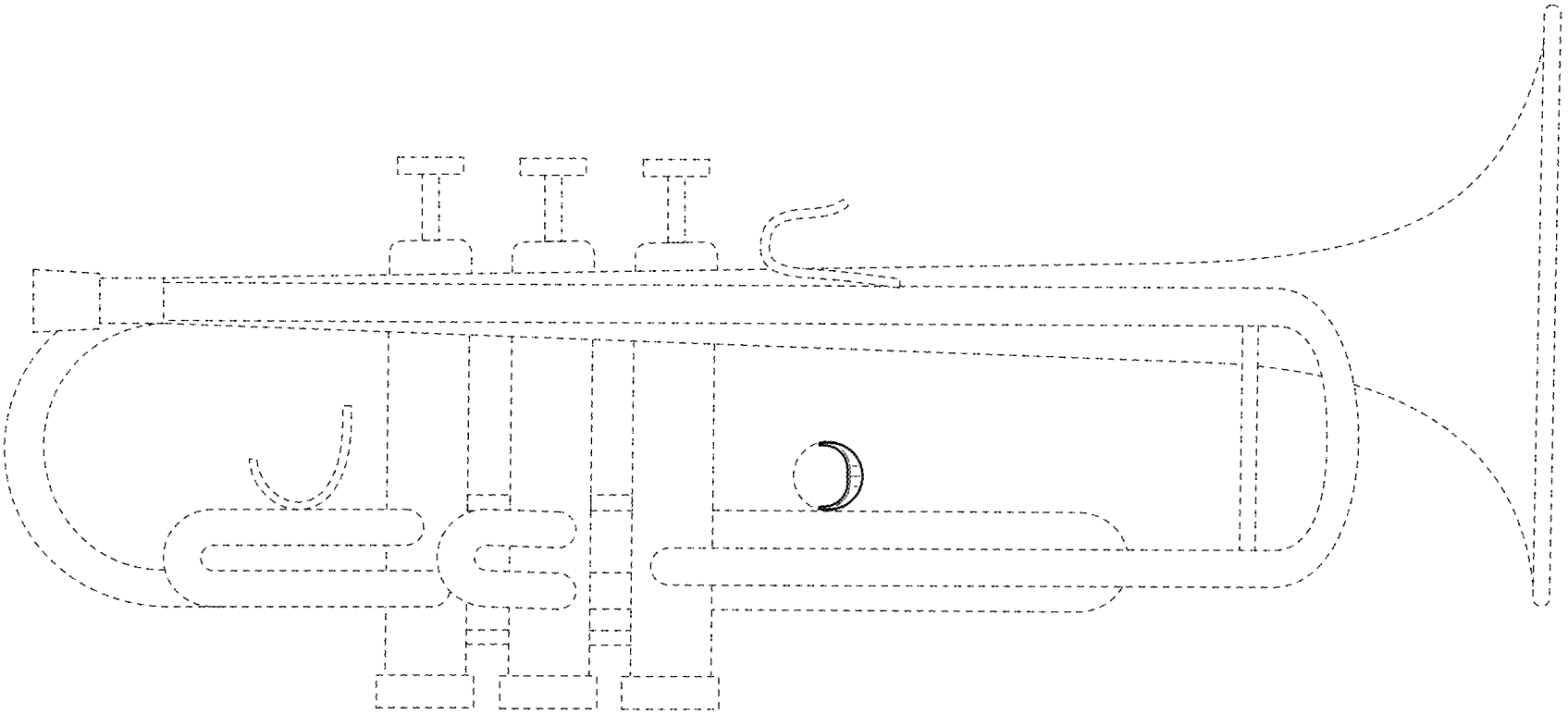

FIGS. 7A-7H show views of another embodiment of a trumpet slide ring fit adapter or spacer. FIG. 7A depicts a front isometric view. FIG. 7B depicts a left side elevational view. FIG. 7C depicts a right side elevational view. FIG. 7D depicts a front side elevational view. FIG. 7E depicts a back side elevational view. FIG. 7F depicts a top plan view. FIG. 7G depicts a bottom plan view. FIG. 7H depicts a right side elevation view of the spacer positioned for use in an instrument with the instrument depicted in broken lines.

Figure 8A:
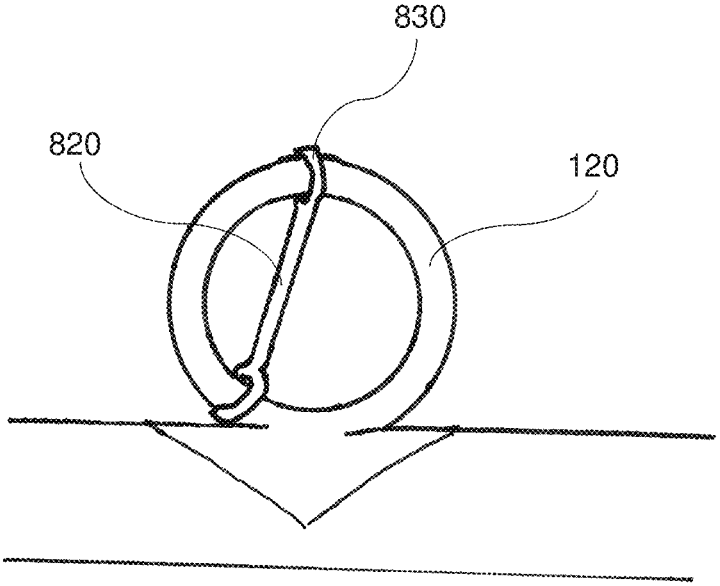
FIGS. 8A-8B show another embodiment of the invention.
Figure 8B:
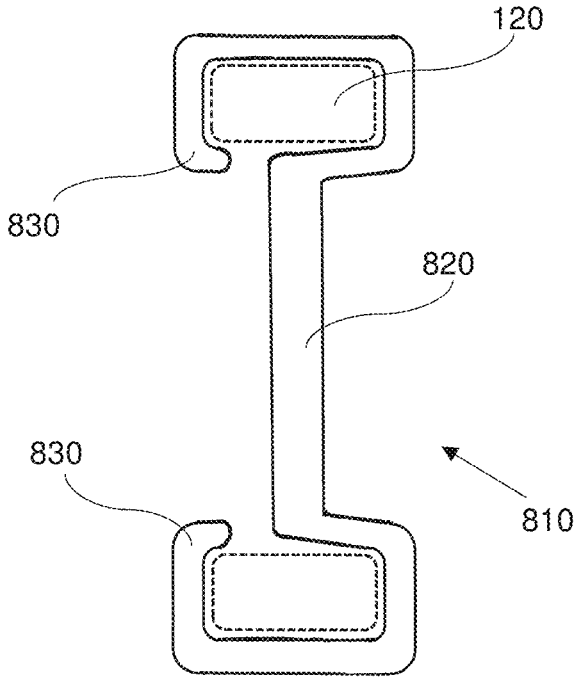

FIGS. 8A and 8B show an embodiment of a slide ring spacer which comprises a band, rod, or strap which extends across a chord of a circular aperture of the slide ring. FIG. 8A shows the spacer mounted across an aperture of a slide ring 120. FIG. 8B shows the mounted spacer 810 with a cut-away view of the slide ring 120 shown in dotted lines. The spacer 810 has an elongated body portion 820 with a ring clip 830 at either end which attaches to the slide ring 120. Each ring clip 830 may partially encircle the slide ring 120 in a poloidal direction. The body portion 820 and clip 830 may both be made of the same material or be made of different materials. Selected materials may be stiff, semi-flexible, or flexible. The clip 830 may comprise a finger-like structure partially encircling the ring poloidally around an edge portion. The clip may comprise a plurality of finger-like structures partially or fully encircling the ring around an edge portion. In some embodiments, the body portion 820 has a flattened, wide midsection for improved comfort and finger contact. In some embodiments, the body portion 820 has rounded edges.

Figure 9:
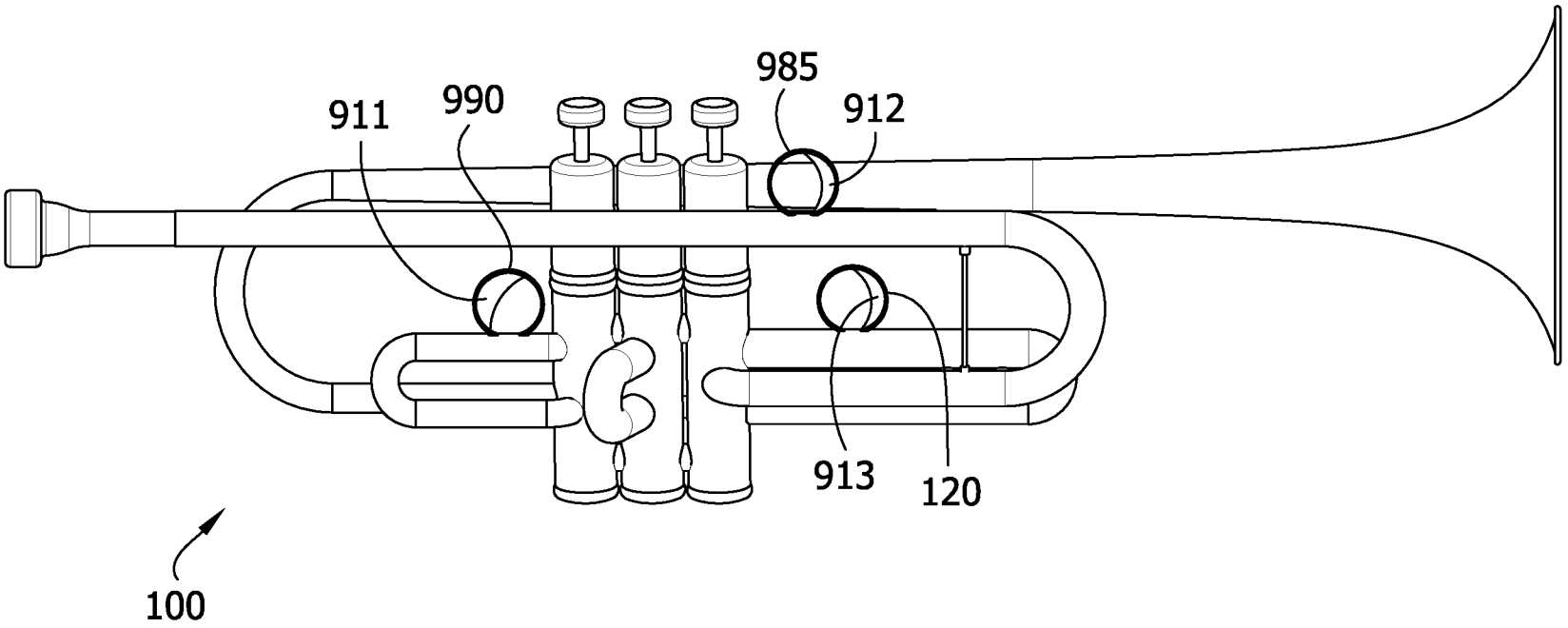
FIG. 9 shows another embodiment of the invention.

FIG. 9 shows a musical instrument having multiple slide rings, each fitted with a spacer. While typical trumpets may have a hook or saddle for manipulating the first and second slide valves, some commercially-available instruments utilize slide rings. In the embodiment shown, the instrument 100 has a first valve slide ring 990, adapted for use with a musician's thumb, a second valve slide ring 985, and a third valve slide ring 120.

A first spacer 911 is shown mounted in the first valve slide ring 990. A second spacer 912 is shown mounted in the second valve slide ring 985. And a third spacer 913 is shown mounted in the third valve slide ring 120. In the embodiments shown, the spacers are substantially crescent-shaped and positioned in each ring outwardly or distally from a player's hand position. Each spacer has an outer semi-circumferential edge forming a ring-seating surface conforming to a respective ring aperture. Each spacer has an inner portion adapted to provide a finger-contacting surface at a selected distance within each ring aperture to adjust each ring fit for a smaller finger size by mounting the spacers in the rings, respectively.

In embodiments of a substantially crescent-shaped spacer, a radial distance between a ring seating surface and a finger contacting surface at a widest part of the crescent defines an inset distance. A spacer may be selected with an inset distance corresponding to a desired gap-filling modification to the slide ring. For example, to fit an instrument to a player with a small finger size, a spacer with a larger inset distance would be selected.

In some embodiments, a substantially crescent-shaped spacer is retained within the third valve slide ring inner circumference without adhesives, based on the stiffness and rigidity of the material used in conjunction with the selected shape. For example, a rigid spacer may be made of a material with a durometer hardness on the Shore A scale of more than about 70, or between about 75-100, 80-100, 85-100, 90-100, 95-100, 85-95, or 95-99.

In some embodiments, a substantially ring-shaped spacer is retained within the third valve slide ring inner circumference without adhesives, and with contact around most or all of the ring inner circumference. In some embodiments a ring-shaped spacer is substantially pliant, For example, a pliant spacer may be made of a material with a durometer hardness on the Shore A scale of less than about 70, or between about 0-70, 15-70, 40-70, or 20-60.

A musical instrument may have a slide ring with an opening diameter of about 2.0 to 3.0 cm, defining a circular opening area of about 12 to 28 square cm. The slide ring may be made of metal, and may have rounded edges in a loop or torus shape. The slide ring may have a radial cross-section thickness of 1-5 mm, or about 2 mm.

A spacer or fit adapter can have an outer rim which forms a lip, flange or side wall, extending out past a seating channel. In some embodiments, a seating channel may substantially correspond to an inner circumference of the slide ring, while an outer rim may extend adjacent the band. In some embodiments, the spacer has one outer rim with a flange adjacent the seating channel. In some embodiments, the spacer has two outer rims having flanges, whereby the seating channel is between the flanges. In some embodiments, a flange is configured to extend out along the band of the slide ring by 25-50% of a band width. The spacer may be mounted by positioning the spacer within an aperture of the ring with the seating channel adjacent a mounting portion of the ring, applying pressure in a radial direction from the finger-contacting surface, and snapping the substantially stiff ring into place.

In an embodiment, a spacer may have one or more attachment hooks or clips which further secure the spacer by wrapping around a portion of a slide ring edge. In some embodiments one or more hooks or clips may extend from at or adjacent a first rim and/or a second rim. Each hook or clip may comprise a finger-like structure partly or fully encircling the ring around an edge portion.

In an embodiment, a substantially crescent-shaped spacer may have a seating channel groove on one side of the spacer. In this embodiment, the groove dimensions would substantially correspond to a segment of a slide ring dimension and an outer edge of the spacer would extend past a seating surface of the spacer. The groove may partly encircle the ring poloidally in a "C" shape, wrapping from an inner circumference of the slide ring, past one side of the ring, and to an outer circumference of the ring. In this embodiment, a spacer may be mounted by positioning the spacer at the segment of a slide ring alongside the ring, applying pressure toward the ring from a side of the spacer, and snapping the ring into place. The ring may be placed such that the groove is located on a side which receives less lateral pressure than an opposite side during play.

A spacer or fit adapter may be configured to reduce the breadth of a slide ring opening along the diameter, as measured along a line parallel to the path of travel, by about 1-50%, 5-50%, 5-45%, 5-40%, 5-35%, 5-30%, 5-25%, 5-20%, 5-15%, 5-10%, 10-50%, 10-40%, 10-30%, 10-20%, 10-15%, or 15-30%. In some embodiments, a method of adjusting a slide ring includes, positioning a fit adapter or spacer such that a maximum distance, measured along a direction of travel, between finger contacting surfaces of the adjusted aperture is 60-85% of the ring aperture diameter.

A fit adapter may be configured to reduce the area of the opening by about 1-40%, 1-30% 1-20%, 1-15%, 1-10%, 5-40%, 5-35%, 5-30%, 5-25%, 5-20%, 5-15%, 5-10%, 10-30%, 10-20%, or 10-15%. In some embodiments, a method of adjusting a slide ring includes, positioning a fit adapter or spacer such that an aperture of the third slide ring is decreased in area by between 5-30%.

In an embodiment, a spacer is substantially stiff, and also compressible or deformable, such that resistance to compression or deformation holds the spacer in position. In embodiments, the as-formed spacer, prior to mounting or insertion into a slide ring, has an outer curvature larger than the inner dimeter of the slide ring. During insertion, the spacer is squeezed, bent, or pushed into position within the aperture of the slide ring. The spacer is subjected to compressive forces by the ring and held in position under static load. In some embodiments, prior to insertion into a slide ring, a crescent-shaped spacer has a seating surface outer curvature which substantially aligns with a portion of a circle having a diameter $D_S$ which is larger than the inner dimeter of the slide ring, $D_R$, into which it is to be fitted. In some embodiments, $D_R$ is 75-95% or 80-90% of $D_S$. In some embodiments, a ratio of $D_R$ to $D_S$ is between about 8:10 to 9:10. In an example, a slide ring having an inner diameter of about 20-22 mm is fitted with a spacer having a seating surface with a curvature of a circle having a diameter of about 23-26 mm. In another example, a slide ring having an inner diameter of about 24-25 mm is fitted with a spacer having a seating surface with a curvature of a circle having a diameter of about 26-29 mm.

In some embodiments the spacer snaps into position into a portion of a ring, hoop, hook, or loop. In some embodiments the spacer may be heated immediately prior to insertion for greater ductility and flexibility during insertion. For example, the spacer may be heated from a room temperature of approximately 25 degrees Celsius, by about 5-10 degrees Celsius by holding it in the hand or placing it in warm water before insertion. For some materials, the spacer may be heated immediately prior to insertion to a temperature of about 30-95 C, 30-75 C, 35-60 C, 30-50 C, 30-45 C, 30-40 C, or 30-35 C.

In some embodiments a spacer may seat into a portion of the inner circumference of a slide ring. For example, a spacer may have a ring seating surface corresponding to a substantial portion of an inner surface around the inner circumference of the slide ring. In some embodiments, more than 50% of the inner circumference of the slide ring abuts the ring seating surface of the spacer. In some embodiments, the ring seating surface abuts about 40-100%, 50-100%, 60-100%, 50-90%, 60-90%, 50-80%, 60-80%, or 30-70% of the inner circumference of the slide ring. In some embodiments, the spacer contacts between 40-80% of an inner circumference around the slide ring and no portion of the spacer contacts an outer circumference of the slide ring.

According to embodiments provided herein, methods, apparatuses and/or structures provide for a trumpet slide ring spacer adapted to be mounted on an instrument and retained within a third slide valve side ring.

Embodiments of the fit adapter may be produced by a number of methods, including but not limited to: 3D printing, injection molding, spin casting, compression molding, thermoforming, casting, punching, cutting, and molding.

Suitable materials for forming embodiments of the fit adapter or spacer include, but are not limited to: thermoset plastic composite, resin, epoxy, fiberglass, plastic, nylon, foam, mineral or carbon fiber reinforced plastic, and composites.

In some embodiments the spacer is formed as a single solid piece. In some embodiments the spacer is formed with gaps, space, or partial infill between a finger contacting surface and a ring seating surface. In some embodiments the spacer is formed from two or more separately formed pieces joined together. In some embodiments a plurality of spacer pieces are fitted and assembled when attached to an instrument. In some embodiments, a spacer, formed as a single solid piece, is mounted onto a slide ring.

Methods provided herein include, a method of moving a valve slide on a musical instrument and a method of playing a trumpet to enhance control of a valve slide. Steps of the method can include, positioning a spacer in a slide ring of a valve slide and actuating the valve slide using the spacer to reduce a distance of travel for a finger in extending a valve slide. In some embodiments, a distance of travel for the finger to fully extend the slide is reduced by about 0.3-1.0 cm.

In some embodiments, a slide ring spacer or fit adapter functions as a finger positioning aid.

In some embodiments, a slide ring spacer or fit adapter is provided in a kit, with a musical instrument, with music educational materials, with instrument accessories, or with fit adapters of other sizes.

Methods provided herein include a method of modifying an effective aperture size of a ring on a musical instrument. Steps of the method can include: identifying a breadth of a gap within a ring aperture between a finger position and an outward edge of the ring aperture along a path of travel; and positioning a spacer into the ring aperture, wherein a widest width of the spacer corresponds to a portion of the breadth of the gap. The spacer may have a ring seating surface configured to rest against, and seat into, at least a portion of an inner circumference of the ring aperture, and a finger contacting surface, connected to the ring seating surface, and radially inset from the ring seating surface. Steps of the method can include positioning the spacer to reduce the gap, so that a maximum distance across a modified aperture, measured along the path of travel adjacent a mid-portion of the spacer, is 50-90%, 60-85%, or 65-80% of the ring aperture diameter.

Methods provided herein include a method of adjusting or modifying the fit of an instrument. Steps of the method can include: measuring a finger size, assessing an aperture size, calculating or estimating a gap between the finger size and the aperture size, selecting a size of a fit adapter, providing the fit adapter, and mounting the fit adapter into the instrument. The fit adapter may have a finger contacting surface inset from a ring seating surface by a distance measured at its widest point. The fit adapter may be selected such that the distance between a finger contacting surface and a ring seating surface corresponds to a portion of the measured or estimated gap. In some embodiments the adapter may be selected to fill a portion of the gap corresponding to about 10-90%, 10-80%, 25-75%, 30-70%, 40-60%, or 30-50% of the gap.

According to embodiments provided herein, a musical instrument can comprise a substantially ring-shaped aperture and a spacer positioned within a region or portion of the aperture.

In some embodiments, a ring seating surface has a seating channel along an arcuate curve configured to seat onto a hoop, loop, or band of a slide ring.

In some embodiments a slide ring spacer or fit adapter is shaped to enhance comfort with ergonomic considerations. In some embodiments, a finger contacting or digit seating surface may be contoured, flared, or shaped to conform to a finger grip. In some embodiments the finger contacting surface is substantially saddle-shaped. In some embodiments the finger contacting surface has a flattened surface perpendicular to a slide ring direction of travel. In some embodiments the finger contacting surface is coated, rubberized, or textured to enhance grip.

Surface treatments may be applied to all or a portion of the exterior surface of the spacer or materials may be selected for surface appearance. In some embodiments, dyes, microparticles, or surface treatments are applied, or embedded, to enhance visual appeal, with color, texture, patterns, or metallic treatment. In some embodiments, surface treatments are added for texturing, embossing, relief, or to improve grip with the application of pliant or elastomeric materials. In some embodiments, surface treatments are applied for personalization, to tag or identify an instrument, or provide a reference to an owner, band membership, or associated information. Added features may include logos, designs, embossed impressions, relief images, alphanumeric characters, paint, tint, stickers, barcodes, radio frequency identification tags, and the like. In some embodiments, surface treatments are added to an outward-facing side surface or portion of a spacer to enhance visual appeal. In some embodiments, surface treatments are added to an inward-facing side, portion, or surface of a spacer to convey information with minimal effect on visual appearance for an audience of the musician.

Structures and treatments may be added to the device, such as structural ribbing, positioning grooves, ridges, cushioning, padding, coating, coloration, logos, pictographs, embossing, texturing, or other elements, without deviating from the scope of the disclosure. As another example, when a specific material is described, other suitable materials may be used, including, for example, composites, natural or synthetic polymers, and plastics.

While specific examples have been described with particular structures, it is understood that permutations, additions, and substitutions may be made. Structures may be oriented in different positions to perform an equivalent function, such as changing orientation or reversing elements of mated components. It is to be understood that positional references, such as inner, outer, top, bottom, upper, lower, are made for ease of explanation and to describe relative position only. Such terms do not specify positional relationships to the instrument, user, or environment unless explicitly stated or necessitated by context.

The terms and expressions which have been employed are used as terms of description and not of limitation. Whenever a range is given in the specification, all intermediate ranges and subranges, as well as all individual values included in the ranges given are intended to be included in the disclosure. It should be understood that, although the present invention has been specifically disclosed by particular embodiments and examples, optional features, modification and variation of the concepts herein disclosed may be used by those skilled in the art, and such modifications and variations are considered to be within the scope of the invention as defined by the appended claims.

What is claimed is:

1. A slide ring spacer for use with a musical instrument having a slide ring comprising:

a ring seating surface configured to rest against, and seat into, at least a portion of a slide ring inner circumference; and a finger contacting surface, connected to the ring seating surface, and radially inset from the ring seating surface.

2. The slide ring spacer of claim 1, wherein the ring seating surface contacts at least 50% of the slide ring inner circumference.

3. The slide ring spacer of claim 1, wherein the ring seating surface contacts 50-80% of the slide ring inner circumference and wherein no portion of the spacer contacts an outer circumference of the slide ring.

4. The slide ring spacer of claim 1, wherein the ring seating surface further comprises a seating channel.

5. The slide ring spacer of claim 1, wherein the finger contacting surface is radially inset from the ring seating surface at a widest point by an inset distance, and wherein the inset distance is about 10-45% of a diameter of the slide ring inner circumference.

6. The slide ring spacer of claim 1, wherein the spacer is substantially crescent-shaped.

7. A method of modifying an aperture size of a ring on a musical instrument, comprising:

identifying a breadth of a gap within a ring aperture between a finger position and an outward edge of the ring aperture along a path of travel; and positioning a spacer into the ring aperture, wherein a widest width of the spacer corresponds to a portion of the breadth of the gap.

8. The method of claim 7, further comprising providing the spacer, wherein the spacer comprises:

a ring seating surface configured to rest against, and seat into, at least a portion of an inner circumference of the ring aperture; and a finger contacting surface, connected to the ring seating surface, and radially inset from the ring seating surface.

9. The method of claim 8, wherein no portion of the mounted spacer fully encircles an edge of the ring.

10. The method of claim 7, wherein positioning the spacer reduces the gap, whereby a maximum distance across a modified aperture, measured along the path of travel, is 60-85% of the ring aperture diameter.

11. The method of claim 7, wherein the method uses no adhesive.

* * * * *